US007128143B2

(12) United States Patent
Van Bilderbeek

(10) Patent No.: US 7,128,143 B2
(45) Date of Patent: Oct. 31, 2006

(54) EXTERNALLY ACTIVATED SEAL SYSTEM FOR WELLHEAD

(75) Inventor: Bernard Herman Van Bilderbeek, Houston, TX (US)

(73) Assignee: Plexus Ocean Systems Ltd.(GB)

( * ) Notice: Subject to any disclaimer, the term of this patent is extended or adjusted under 35 U.S.C. 154(b) by 109 days.

(21) Appl. No.: 10/751,244

(22) Filed: Dec. 31, 2003

(65) Prior Publication Data

US 2005/0139360 A1 Jun. 30, 2005

(51) Int. Cl.
*E21B 19/00* (2006.01)

(52) U.S. Cl. ..... 166/96.1; 166/75.13

(58) Field of Classification Search ..... 166/88.2, 166/88.3, 89.1, 89.3, 96.1, 217, 379, 387, 166/75.13, 85.1, 75.11; 285/123.1, 123.14, 285/382.7

See application file for complete search history.

(56) References Cited

U.S. PATENT DOCUMENTS 2,097,615 A * 11/1937 Burns et al. ..... 166/88.2
3,795,963 A * 3/1974 Sturmey ..... 29/731
4,913,469 A 4/1990 Baugh ..... 285/146
5,031,695 A 7/1991 Cain et al. ..... 166/75.1
5,996,695 A * 12/1999 Koleilat et al. ..... 166/382
6,092,596 A 7/2000 Van Bilderbeek ..... 166/89.1
6,488,084 B1 12/2002 Borak, Jr. ..... 166/208
6,598,680 B1 * 7/2003 DeBerry ..... 166/368
6,662,868 B1 12/2003 Van Bilderbeek ..... 166/89.1

FOREIGN PATENT DOCUMENTS

EP 0251595 1/1988

* cited by examiner

*Primary Examiner*—David Bagnell
*Assistant Examiner*—Daniel P Stephenson
(74) *Attorney, Agent, or Firm*—Jackson Walker L.L.P.; Mark A. Tidwell, Esq.

(57) ABSTRACT

A method and apparatus for a seal assembly for a unitized wellhead system for land or platform applications utilizes a friction grip technology to create maintainable metal-to-metal seals with finely-controlled contact stresses, lock-down casing and tubing hangers, support test loads to minimize the size of landing shoulders required, and to rotationally lock casing hangers to provide simplified running procedures. The system can be used in combination with a friction grip clamping assembly to greatly streamline the wellhead design.

40 Claims, 5 Drawing Sheets

EXTERNALLY ACTIVATED SEAL SYSTEM FOR WELLHEAD

BACKGROUND OF THE INVENTION

1. Field of the Invention

The invention is related to concentric casings and strings in wellheads wherein it is necessary to effect a seal between concentric members of the wellhead and is specifically directed to a seal system wherein the sealing members are activated via an external, non-invasive seal energizing system.

2. Discussion of the Prior Art

In oil and gas wells, it is conventional to pass a number of concentric tubes or casings down the well. An outermost casing is fixed in the ground, and the inner casings are each supported from the next outer casing by casing hangers which take the form of inter-engaging internal shoulders on the outer casing and external shoulders on the inner casing.

Typically, such casing hangers are fixed in position on each casing. There are however applications where a fixed position casing hanger is unsatisfactory, because the hang-off point of one casing on another may require to be adjusted. Such drilling wellheads have to accommodate a casing with an undetermined hang-off point, it has been known to use casing slip-type support mechanisms.

Wellheads are used in oil and gas drilling to suspend casing, seal the annulus between casing strings, and provide an interface with the BOP. The design of a wellhead is generally dependant upon the location of the wellhead and the characteristics of the well being drilled or produced. One specific type of wellhead is a unitized wellhead for platform or land applications.

Unitized wellheads are composed of several individual components, including a wellhead housing that is used to support a number of casing hangers and tubing hangers. The hangers support the weight of the casing and tubing, and pass loads back to the wellhead housing. Annulus seals seal the annular spaces between casing and tubing strings.

Conventional land or platform wellheads are either slip-type conventional wellheads or through-the-BOP multi-bowl wellheads.

Slip-type wellheads use casing slips to support casing strings. These slips are friction wedges that "grip" the top of a casing string and use slip teeth to bite into the casing. Wellheads of this type require higher-risk operations, as they require lifting the BOP to install casing slips and annulus seals. The seals that are used with slip-type casing hangers must be actively maintained throughout the field life of the well.

Multi-bowl type wellheads feature reduced-risk operations, as the BOP does not need to be lifted to set casing slips. Instead of using slips, a multi-bowl wellhead uses a fixed landing shoulder in the wellhead housing to support the first casing hanger. All other casing hangers are stacked on top of this initial casing hanger. The seals installed on multi-bowl wellheads can be more dependable than those installed in slip-type wellheads, but are still often unreliable, due to eccentricities in the casing hanger/wellhead alignment and unreliability in the seal setting mechanisms. As the initial load shoulder must support the weight of all casing strings and any loads due to test pressures, this load shoulder must intrude into the bore of the wellhead quite a bit. This can create an operational restriction that limits operations through this well.

Various sealing devices are known and employed in such wellheads. One example of a sealing assembly is shown and described in U.S. Pat. No. 4,913,469, wherein a wellhead slip and seal assembly includes a slip assembly with slips supported within a slip bowl and a seal assembly positioned above the slip assembly and interconnected thereto for supporting the slip assembly, the seal assembly includes two segments connected to form the seal ring and each of the segments includes arcuate elements embedded in a resilient material which forms an inner seal in an inner groove. The segments of the slip bowl include segments interconnected by toe nails and the seal ring includes pin and recess connection for connecting the two segments together.

It is also known from European Patent No. 0 251 595 to use an adjustable landing ring on a surface casing hanger to accommodate a space-out requirement when the casing is also landed in a surface wellhead.

More recently, and as shown and described in my U.S. Pat. Nos. 6,092,596 and 6,662,868, an external clamp for clamping two concentric tubes, typically two concentric tubes in an oil or gas well, has two axially movable tapered components which can be pulled over one another in an axial direction to provide a contraction of internal diameter which grips the smaller diameter tube.

Another example of a sealing system is shown and described in U.S. Pat. No. 5,031,695, wherein a well casing hanger with a wide temperature range seal element is energized by axial compression with a pre-determined initial portion of the casing hang load, the remaining portion of that hang load then being transferred to the wellhead or other surrounding well element without imposition on the seal element.

U.S. Pat. No. 6,488,084 shows and describes a casing hanger adapted for landing on a load shoulder in a wellhead to seal and support a string of casing. The casing hanger has a lower ring for landing on the load shoulder, the lower ring having an upward facing surface. A plurality of circumferentially spaced recesses are in the upward facing surface of the lower ring, each of the recesses having a base. A seal is located on the lower ring and has a plurality of holes that register with the recesses in the upward facing surface of the lower ring. A slip assembly bowl has a wedging surface that carries a plurality of slip members. The slip members grip the casing and cause the bowl to transmit downward forces from the casing to the seal to axially compress and energize the seal. Fasteners extend from the lower ring through apertures provided in the seal into threaded apertures provided in a downward facing surface of the bowl to secure the lower ring to the slip assembly but allow relative axial movement between the bowl and the lower ring. A plurality of substantially cylindrical stop members are located in the holes in the seal and in the recesses of the lower ring. The stop members are secured into threaded holes formed in the shoulder ring and contact the bases of the recesses to limit the compression of the seal to a predetermined amount.

SUMMARY OF THE INVENTION

The subject invention is directed to a method and apparatus for a seal assembly for a unitized wellhead system for land or platform applications utilizing a friction grip technology to create maintainable metal-to-metal seals with finely-controlled contact stresses, lock-down casing and tubing hangers, support test loads to minimize the size of landing shoulders required, and to rotationally lock casing hangers to provide simplified running procedures.

The subject invention that combines the benefits of a slip-type wellhead and a multi-bowl type wellhead and is able to provide numerous advantages by using radial compression of the wellhead to create seals and support load.

In its simplest form, the invention provides the apparatus and method for accomplishing a circumferential seal between two substantially concentric members by externally activating the seal once the two members are in position. In a typical configuration, a wellhead housing accommodates and supports a concentric tubing hanger. The tubing hanger may be supported within the wellhead in any of the conventional ways.

One suitable method for supporting the tubing hanger in the well is the clamping mechanism shown and described in my previously mentioned U.S. Pat. Nos. 6,092,596 and 6,662,868, incorporated herein by reference. Using the system there described, a friction fit is provided between the inner diameter of the wellhead housing and the outer diameter of the tubing hanger. Once properly positioned, a compressor system mounted on the exterior of the wellhead housing is activated, whereby the a cam or ramp surface on the compressor system is moved axially relative to a mated cam surface on outer circumference of the wellhead housing to compress the wellhead housing radially inward for engaging and clamping the tubing hanger along coextensive surfaces.

The present invention is directed to a sealing mechanism comprising a compression system such as that shown in my aforementioned patents, metal-to-metal sealing members, and where desired, redundant resilient seals. In the preferred embodiment the sealing members are integral, machined surface on the outer circumferential wall of the tubing hanger and inner circumferential wall of the wellhead housing.. The sealing surface extends circumferentially about the walls. The sealing surface of the tubing hanger is best designed to clear the inner diameter of the wellhead housing, i.e., there is not any radial interference between the sealing surface of the tubing hanger and the interior wall of the wellhead housing. This preserves the integrity of the seal during assembly. Once the tubing hanger is positioned in the wellhead housing, the seal is activated by the compressor system., compressing the wellhead housing radially inward to engage the seal.

The sealing assembly of the subject invention provides for a flexible design that can be used for a variety of specific applications, as will be described herein. The simple design promotes dependability and reduces size of the overall architecture of the well. The resulting wellhead assembly has near-zero eccentricity between hangers and housing with near-zero torque and minimal axial setting load required to energize metal-to-metal annular seals The sealing assembly may include external test capability for metal-to-metal annular seals.

It is an important aspect of the invention that the sealing mechanism is activated by external lockdown and sealing activation. The rigid lockdown eliminates annular seal fretting, with contact stress evenly distributed around seal perimeter.

The sealing assembly permits controlled and monitored application of seal loading.

The annular seals are maintainable throughout field life.

A minimal number of running tools are required since hangers are locked in place torsionally. A high-torque connection, e.g., a standard casing coupling on the end of a standard casing string, can be used to run the hangers.

It is an important feature of the design that the primary load shoulder can be smaller than conventional multi-bowl load shoulders, as much of the load is supported through the various friction-grip interfaces. This smaller load shoulder means that the bore through the wellhead is increased, allowing the first casing string run through the wellhead to be larger in size. Alternately, a smaller load shoulder can allow the outer diameter of the wellhead to be decreased while maintaining the diameter of the casing, resulting in a smaller overall size.

The friction and gripping areas function over a length. Therefore, if the first casing hanger is landed high, subsequent casing/tubing hangers can tolerate this stack-up error by landing and sealing at slightly different places along the functional bore length.

The tubing hanger can be nested to reduce the work-over stack dimension.

The friction grip area supports test loads on the tubing hanger permitting the tubing hanger load shoulder to be smaller than it prior art configurations. More space is then available in the tubing hanger to maximize the number of control line penetrations through the tubing hanger.

The design of the subject inventions minimizes the number of wellhead penetrations. All contingency procedures can be performed through the blow out preventers (BOP's).

Due to minimizing stress and torque, the system is a fatigue resistant design for dynamic applications. The flexible design allows incorporation of tensioned casing and tubing hangers.

In the preferred compression system, the use of hydraulic pistons and lock nuts to activate and lock the flanges allows for a simplified flange design.

The push-through wear bushing does not need to be retrieved, saving an operation.

Internal tubing hanger lockdown can be accomplished without a dedicated handling tool and without potential control line damage Improved safety, with tubing back-side test, is achieved without the use of a temporary seal or temporary lockdown mechanism on tubing hanger.

Other features of the invention will be readily apparent from the accompanying drawings and detailed description of the preferred embodiment.

DESCRIPTION OF THE INVENTION

Figure 1:
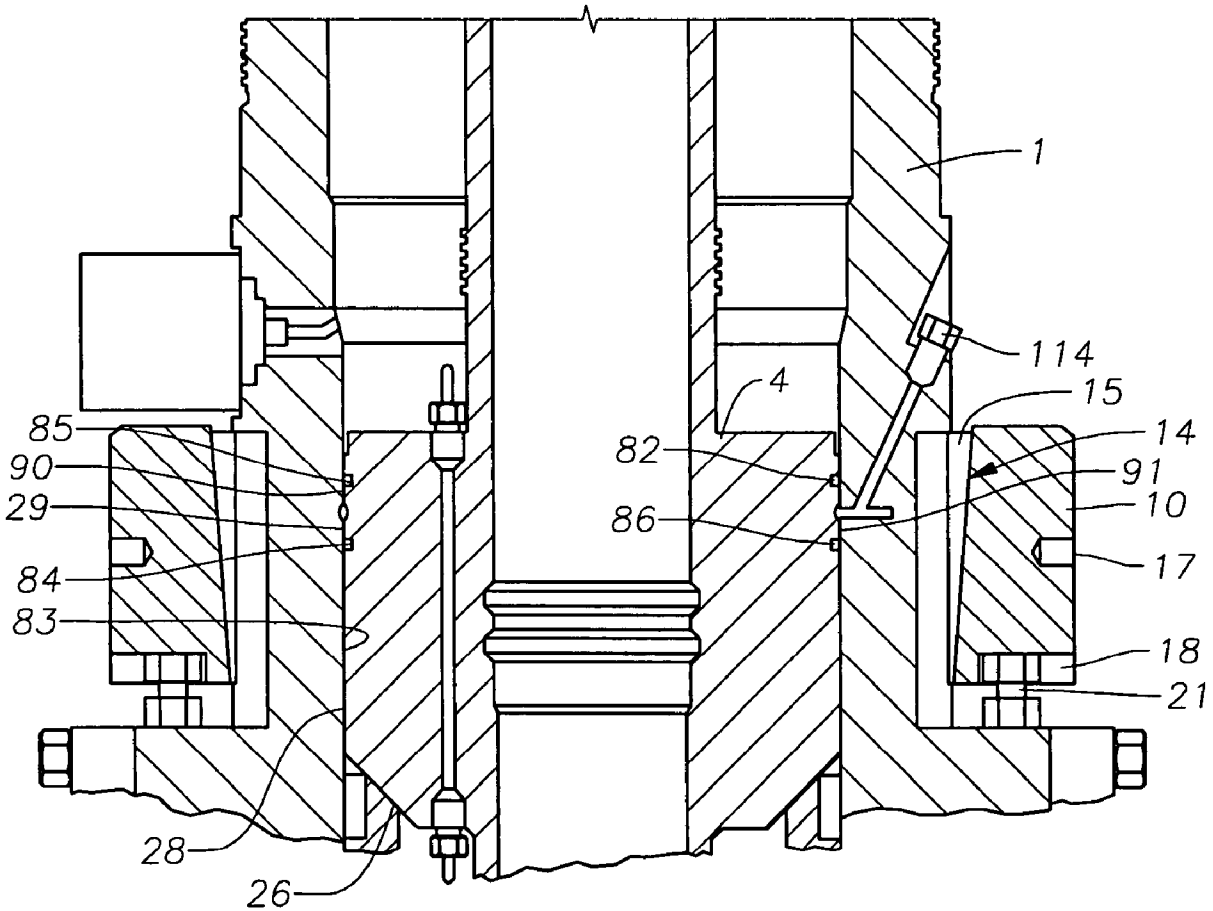
FIG. 1 is a simplified cross-section of a wellhead showing the seal system in detail.

A simplified, diagrammatic view of the seal system to the subject invention is shown in FIG. 1. In its simplest form, the invention provides the apparatus and method for accomplishing a circumferential seal between two substantially concentric members by externally activating the seal once the two members are in position.

With specific reference to FIG. 1, a wellhead 1 includes having an external sealing apparatus 10 for clamping a tubular casing 4 of a first diameter within a tubular casing (here the wellhead 1) of larger internal diameter. The outer tubular member has an inner circumferential wall with a sealing zone 83. The inner tubular member is adapted to be positioned substantially concentrically within the outer tubular member having an outer circumferential wall with a sealing zone 28. The circumferential compression system 10 is mounted outwardly of the outer tubing member and operable to be activated for compressing the outer tubular member into contact with the inner tubular member for engaging the sealing zones therein and activating a seal between the outer tubular member and the inner tubular member. The sealing zone on each tubular member may be a metal sealing surface on each of said tubular members for defining a metal-to-metal seal when the compressions system is activated. Where desired, the wellhead sealing system may include one or more resilient seal members 84, 85 in the sealing zone of one of the tubular members and extending outwardly therefrom toward the other tubular member, wherein the resilient seal member is adapted to be compressed between the two tubular members when the compression system is activated. Where multiple resilient sealing members are used, a gap 91 is created between the resilient seal members when the compression system is activated. A test port 114 may be provided for communicating the gap with the exterior of the assembly for testing the integrity of the seal when activated. In the preferred embodiment the compression system comprises a wedge surface 15 and a flange 14 adapted for engaging the wedge, one of said wedge and flange being each located on one of the outer tubular member and the compression system, whereby the tubular member is compressed radially inwardly upon relative axial movement between the wedge and the flange. The preferred method for activating the compression system is a hydraulic ram adapted for causing axial movement between the wedge and the flange. The system includes a positive lock 21 for locking the wedge and flange in position once the seal has been engaged.

In its broadest sense the invention is a method for providing an external sealing device for concentric tubular members in a wellhead. The method comprises placing sealing zones on the mated surfaces of a plurality of concentric tubular members in radial alignment with one another and compressing the outermost tubular member toward the central axis of the concentric tubular members for engaging the sealing zones with one another. As described above, in the preferred embodiment the method includes the step of locking the compressed assembly in sealing position. Where desirable, a redundant resilient seal is positioned in the sealing zone. When a plurality of axially spaced resilient seals are located in the sealing zone, the gap between the resilient seals may be ported to the exterior of the system.

As shown in FIG. 1, and by way of example, a wellhead housing 1 accommodates and supports a concentric tubing hanger 4. As will be further described, additional concentric tubular members may also be sealed using the system of the subject invention. The tubing hanger may be supported within the wellhead in any of the conventional ways. One suitable method for supporting the tubing hanger in the well is the clamping mechanism shown and described in my earlier U.S. Pat. No. 6,092,596, incorporated herein by reference. Using the system therein described, a friction fit is provided between the inner circumferential wall 83 of the wellhead housing and the outer circumferential wall 28 of the tubing hanger 4. Once properly positioned, the compressor system 10 mounted on the exterior of the wellhead housing 1 is activated by the threaded driver 20, 21, whereby the compression flange 14 on the compressor system is moved axially relative to the compression wedge 15 on outer circumference of the wellhead housing to compress the wellhead housing radially inward for engaging and clamping the tubing hanger along the coextensive surfaces 28 and 83. As shown in my aforementioned patents, the compression system may comprise an annular, axially tapering surface, an axially movable sleeve surrounding the outer wall of the wellhead and has a corresponding tapering surface facing the outer wall, and a driver for producing relative axial movement between the tapering surfaces to exert a radial compressive force to the outer wall of the wellhead. The means for producing relative axial movement comprises a pressure chamber between the sleeve and the wellhead, and means for pressurising the chamber with hydraulic pressure. Alternatively, the means for producing relative axial movement may comprise a flange on the sleeve, a flange on the wellhead, and means for applying a mechanical force between the flanges to move the sleeve axially along the wellhead.

The present invention is directed to the sealing mechanism comprising the compression system 10, the metal-to-metal sealing member 29, and where desired, redundant resilient seals 84 and 85. In the preferred embodiment the sealing member 29 may is an integral, machined surface on the outer wall 28 of the tubing hanger. The sealing surface extends circumferentially about the outer wall of the tubing hanger. The sealing surface is best designed to clear the inner wall of 83 of the wellhead housing, i.e., there is not any radial interference between the sealing surface of the tubing hanger and the interior wall of the wellhead housing. This preserves the integrity of the seal during assembly. Once the tubing hanger 4 is positioned in the wellhead housing 1, the seal is activated by driving the compression flange 14 of the compressor system 10 relative to the compression wedge 15 mounted on the wellhead housing 1, forcing the wellhead housing to compress radially inward about the entire circumference and engage the seal.

In the preferred embodiment, the metal-to-metal seal includes mated and complementary sealing surfaces 29 and 90 on both the exterior wall of the tubing hanger and the interior wall of the wellhead housing.

Resilient back up seals 84, 85 may also be provided. As shown in FIG. 1, the exterior wall of the tubing hanger includes channels 86, 87, for receiving an the resilient o-ring type resilient seal 84, 85. The channels and o-rings could also alternatively be housed in the interior wall of the wellhead housing. The resilient seal system is also activated by the compressor system 10.

It is also desirable to provide a seal test port 114 in communication with the seal for testing its integrity once activated.

The seals are released by decompressing the compressor system 10 to withdraw the ramp surface 14 axially downward from the ramp surface 16 via the screw drive system 21. The drive means may be any of a number of systems which support the exertion of circumferential pressure on the outer wall of the wellhead. Examples of such systems are shown and described in my U.S. Pat. No. 6,662,868 and copending application U.S. Ser. No. 10/721,443. All of these are incorporated by reference herein.

It is, therefore, the essence of the invention to provide a sealing mechanism for sealing the annulus between two relatively concentric tubular members by activating and engaging a sealing member via an external force applied to the assembly for compressing the outer member into the inner member.

It should be noted that the seal mechanism must be distinguished from the clamping mechanism described in the aforementioned patents. As will be readily understood, sufficient clamping can be accomplished by compressing the outer member into the inner member whether or not full circumferential contact is achieved. It is the important enhancement of the subject invention that means are provided to assure complete contact along the circumferential walls of the two member to effect a seal once the compression is completed.

Figure 2:
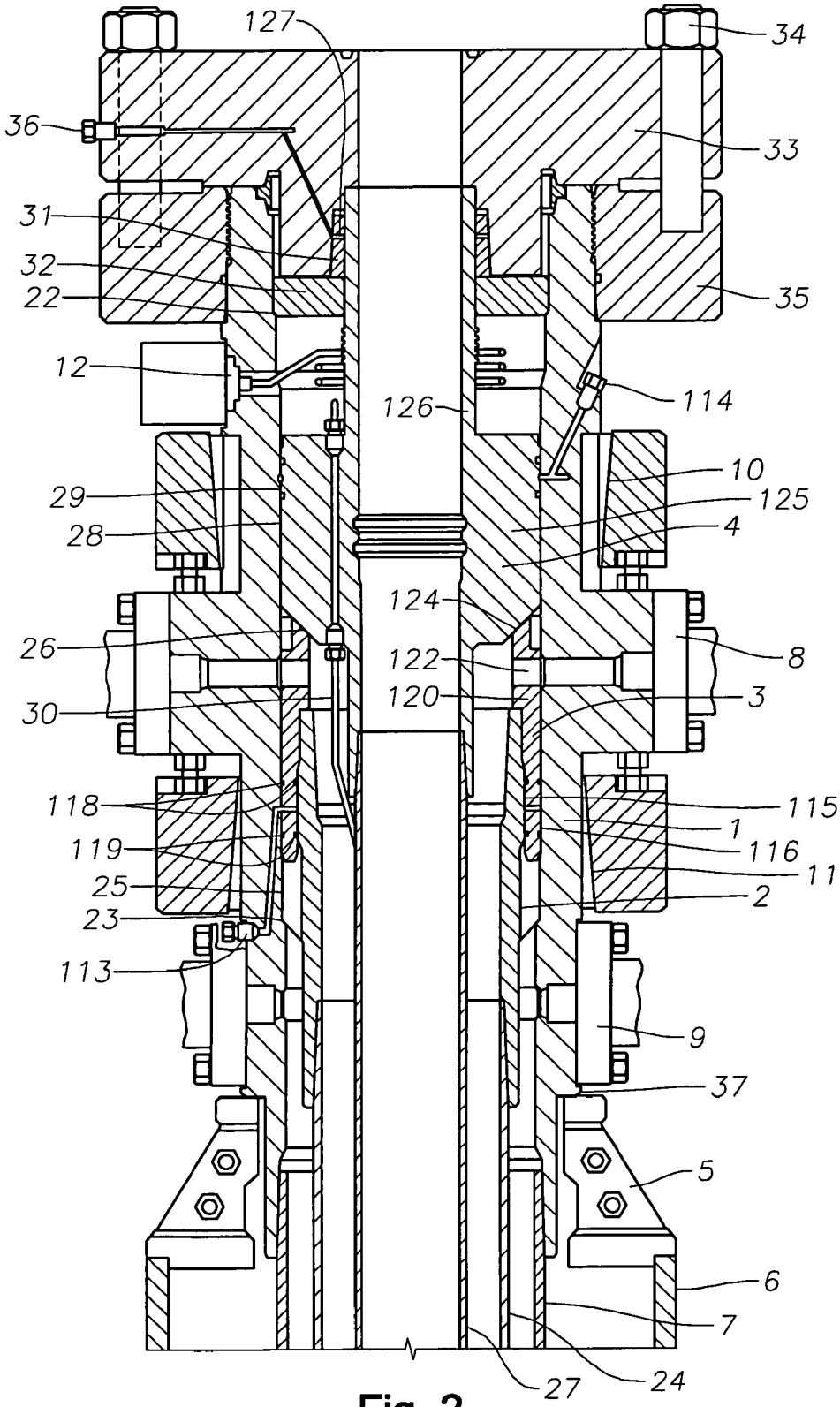
FIG. 2 is a cross-section of a typical wellhead configuration incorporating the seal system of the subject invention.

FIG. 2 depicts a simple configuration of a three-string wellhead system utilizing the clamping system of my aforementioned patents and the sealing system of the present invention. The main components of this system are a wellhead housing 1, a production casing hanger 2 with annulus seal assembly 3, and a tubing hanger 4. The entire assembly is supported on a base plate 5 that sits on the conductor string 6.

A load shoulder 37 on the support plate supports the wellhead housing. The wellhead housing 1 supports the weight of the intermediate casing string 7 in a traditional manner (in this case, via a threaded casing coupling connection in the bottom of the wellhead housing). The exterior of the wellhead housing features two sets of annulus access ports 8 and 9, two clamping compression systems 10 and 11, a control-line access port 12, two sets of external seal test ports 113 and 114, and a thread-on flange profile up. A thread on flange 35 attaches to this profile to interface with the tree adapter 33.

The bore of the wellhead housing is featured with a number of sealing profiles and lockdown profiles for the casing hanger, seal assembly, and tubing hanger. These bores may be on a series of steps so that each higher bore is on a slightly larger diameter, therefore protected from operations on the smaller diameter bores. At the top of the wellhead housing bore is an index shoulder 22 for the tubing hanger neck seal and a gasket sealing profile. At the bottom of the wellhead housing bore is a load shoulder 23 that is sized to support the casing weight of the production casing string only. Any additional axial load (for instance load from other casing strings or from test pressures) passes through the friction-grip lockdown areas.

The production casing hanger 2 features a casing thread profile down for support of the production casing string 24 and a casing thread profile up to interface with the casing hanger's casing running string (not shown). The exterior of the casing hanger features a load shoulder that is slotted to allow flow-by and cement returns to pass the exterior of the casing hanger as it is being run. The external surface of the load shoulder area 25 is a controlled surface featuring a friction profile. When the casing hanger is landed, this friction surface is parallel to a mating surface in the bore of the wellhead housing. External compression of the wellhead housing provided by the lower compression cartridge 11 forces the two surfaces to be perfectly concentric and brings them into contact. Friction at this interface provides rotational and axial lock-down support for the casing hanger, as well as additional load support for production casing weight and test loads on the production casing hanger. Above the casing hanger load shoulder is a profile for the annulus seal system 3.

The annulus seal 3 fits between the production casing hanger 2 and the inner bore of the wellhead housing 1. The seal features two sets of seal profiles 115, 116 on both the inner and outer diameters, respectively. The outer diameter and inner diameter seal profiles feature two pairs each of metal-to-metal seals as well as resilient seal back-ups 118, 119. A port 113 between the two sets of seals allows external testing of all seals created by the seal assembly. These seal profiles do not have initial radial interference with either the casing hanger or the wellhead housing. Rather, interference (and radial contact pressure) is provided by external compression of the wellhead housing through the use of the lower compression cartridge 11. An extended neck 120 on the seal assembly protrudes above the top of the casing hanger. This extended neck features ports 122 to allow communication between the production/tubing annulus and the upper annulus access port 8 in the wellhead housing. The top of the seal assembly serves as a landing shoulder 124 for the tubing hanger 4 at load shoulder 26.

The tubing hanger 4 supports the tubing string 27 with a threaded connection down. The thicker main body 125 of the tubing hanger provides a load shoulder 26 that lands on top of the production casing hanger annulus seal assembly on landing shoulder 124. This load shoulder supports full tubing string weight only. Any additional axial loads (for instance, loads due to test pressure) are supported by the friction-grip lockdown area. The outer diameter of the thick section 125 of the tubing hanger features a friction-lock profile 28 below a sealing profile 29. The friction profile is a machined surface suitable for support of friction loads. The sealing profile consists of a pair of metal-to-metal seal bumps with resilient back-ups, as described with above and shown more clearly in FIGS. 1 and 3. Both of these profiles are parallel to mating surfaces on the wellhead housing bore, and have no initial interference. When the upper compression cartridge 10 is activated, that section of the wellhead housing is compressed inwards to contact the tubing hanger. Contact pressure along this interface forces the pieces to be concentric, provides axial and rotational lockdown of the tubing hanger, and activates the metal-to-metal seals with resilient back-ups. The friction interface supports any test pressure loads on the tubing hanger.

Hydraulic control lines 30 pass through the tubing hanger body in a conventional manner. The tubing hanger features an extended neck 126 upwards. This neck features a tubing connection box up to interface with the tubing running string (not shown). Below this threaded box is a seal profile to accept the tubing hanger neck seal.

The tubing hanger neck seal 31 sits on a support ring 32 that is carried on the tubing hanger neck and indexes on a load shoulder in the wellhead housing bore. The seal sits on the upper face of this support ring, and features metal-to-metal seal profiles on both the straight inner diameter and the tapered outer diameter. A port 127 between these seal profiles allows external testing of all seals created by the tubing hanger neck seal via an external test port 36 in the Christmas tree adapter 33. This seal is activated as the Christmas tree adapter 33 is drawn by studs and nuts 34 down onto the wellhead housing. Movement over the tapered external surface of the tubing hanger neck seal compresses the seal inwards and creates high radial contact pressures on both the seal inner diameter and the seal outer diameter.

Figure 3:
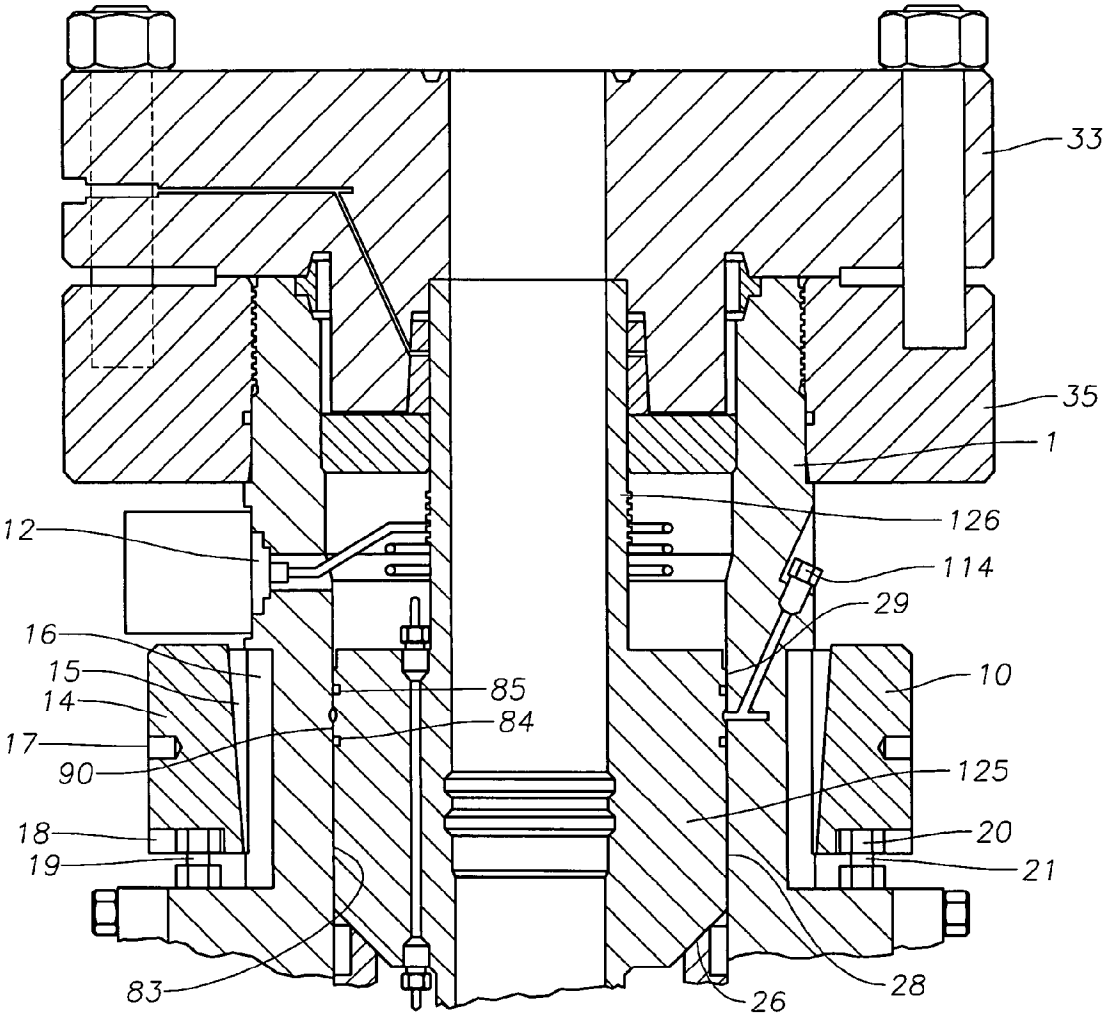
FIG. 3 is an enlarged fragmentary view of the seal system of FIG. 1, and corresponds generally to FIG. 1.

FIG. 3 is an enlarged a detail of the system shown in FIG. 2, generally in the area of the upper compressor system 10. FIG. 3 is generally of the same cross-section of FIG. 1, but with all of the detail of the wellhead housing of FIG. 2.

Each POS-GRIP compression system is composed of a compression flange 14 and a compression wedge 15. The compression flanges are rings with tapered inner surfaces that mate with the tapered outer surfaces of the compression wedges. Axial movement of the compression flanges over the compression wedges compresses the compression wedges inwards, in turn compressing a portion of the wellhead housing 1 inwards (within the wellhead housing's elastic range). The compression systems may be configured with a split spacer ring 16 between the compression wedge and the wellhead housing, as shown in the top compression system 10 of FIG. 2. The split spacer rings have minimal hoop stiffness, and simply pass the radial contact loads from the compression wedge into the wellhead housing.

The compression flanges have handling profiles 17 on the flange outer diameters. These handling profiles interface with a release tool (not shown) that can be used to push the flanges apart, releasing the compression. The compression flanges also have activation and locking profiles 18 cut into the wide end of the flanges. These profiles accept a set of small hydraulic pistons (not shown) during activation. These hydraulic pistons react against the thick section of the wellhead housing in the region of the upper annulus access port 8, see FIG. 2. When pressure is applied to a set of hydraulic pistons, the associated compression flange is pushed away from the thick section of the wellhead housing into the "activated" position. Once the compression flange has been moved into its activated position, mechanical lock nuts 19 replace the hydraulic pistons in the locking profiles, and are used to lock the flange in the activated position.

The lock nuts consist of a male thread member 20 and a female thread member 21. The male thread member has a threaded length and a flat face at one end to sit on the wellhead housing. The female thread member has threads to mate with the male thread member and a flat face to react on the compression flange. Rotation of the female thread member on the male thread member allows the lock nut to adjust in length, to fill whatever gap is developed between the wellhead housing and the compression flanges during activation of the compression system. Once the lock nut has been adjusted to the necessary length, it effectively locks the compression flange in its current position, so that the hydraulic pistons may be removed.

Figure 4:
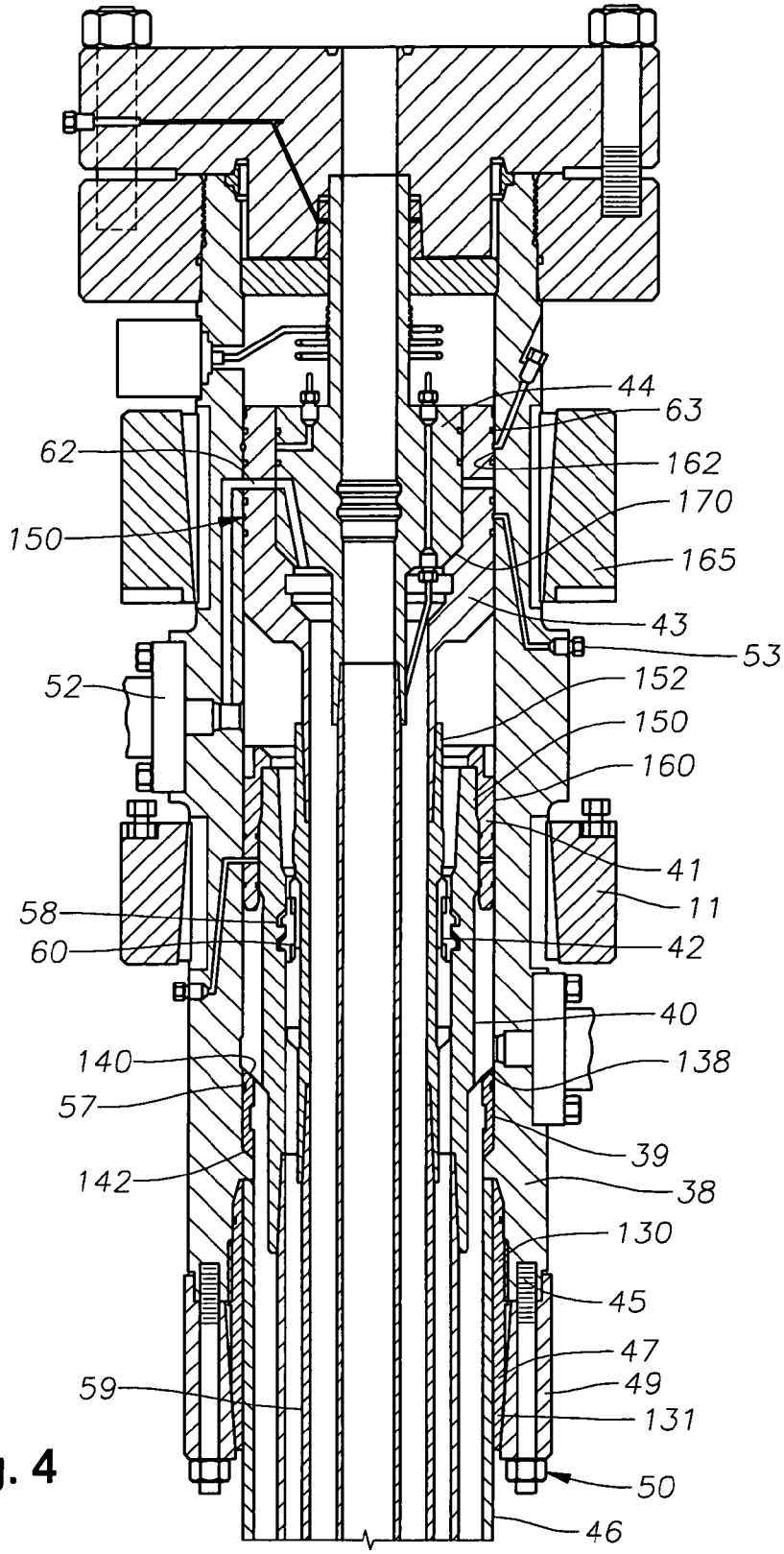
FIGS. 4 is a cross-section of a typical wellhead configuration incorporating the seal system of the subject invention with the tubing hanger nested to reduce the work-over stack dimension.
Figure 5:
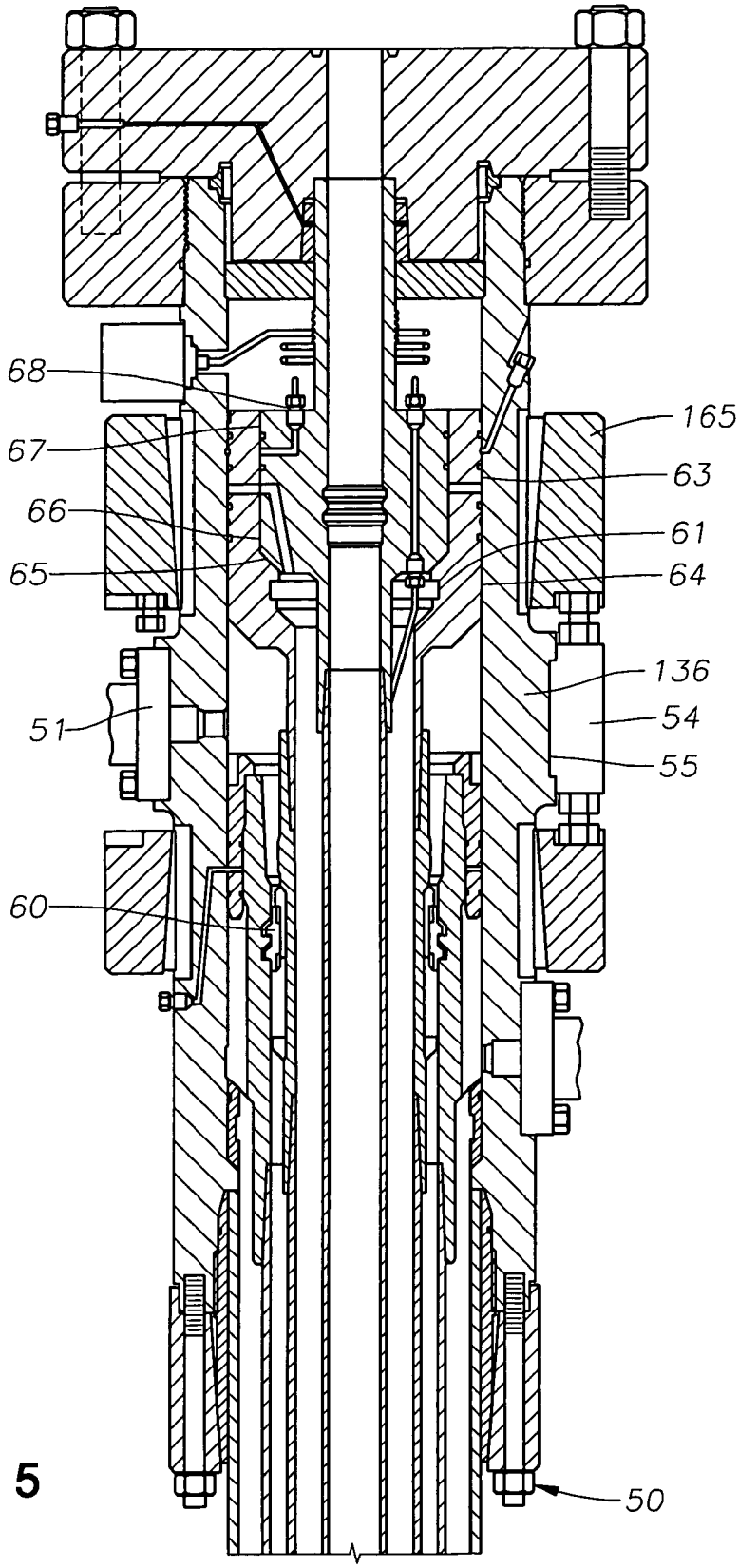
FIG. 5 is a cross-section of the wellhead of FIG. 4 taken at a 90 degree rotation from that of FIG. 4.

FIGS. 4 and 5 depict two separate sections of a more involved configuration of a four-string wellhead. The main components of this system are a wellhead housing 38, a push-through wear bushing 39, an intermediate casing hanger 40 with annulus seal assembly 41. The annulus seal assembly is of the same configuration as that shown in FIG. 2 and is activated in a similar manner by the lower compression system 11. There is also a production casing hanger 42, a seal and support sub 43, and a tubing hanger 44.

The assembly shown in FIGS. 4 and 5 uses an alternate means of wellhead support. In this case, the entire assembly is supported on a friction support mechanism 45 that connects the bottom of the wellhead housing to the top of a large-diameter casing string 46. The friction support mechanism consists of a gripping sub 47, a compression sub 49, and a set of studs and nuts 50. This gripping system comprising gripping sub 47, compression sub 49 and the driver 50, operates in accordance with the gripping system shown and described in my aforementioned patents. The gripping sub is connected to the inner diameter of the wellhead housing 38 via a threaded profile at 130 with a metal-to-metal seal. The lower portion 131 of the gripping sub consists of a friction and sealing profile on the inner diameter and a tapered surface on the outer diameter. The friction profile diameter fits as a socket around the casing string 46. The tapered diameter mates with a tapered surface on the compression sub 49. As the compression sub moves upwards over the taper, the gripping sub is compressed inwards. This closes the gap between the gripping sub and the outer diameter of the casing, and creates a high radial contact pressure between the two pieces. This high radial contact pressure provides a metal-to-metal seal between the gripping sub and the casing. Friction at this interface locks the pieces together axially and rotationally.

A set of studs and nuts 50 connect the compression sub 49 to the wellhead housing 38. It is movement of the nuts along the studs that causes the compression sub to move upwards along the tapered compression sub/gripping sub interface.

The wellhead housing 38 is largely the same as that shown in FIG. 2. The wellhead housing in FIGS. 4 and 5 features a third annulus access port 52 (FIG. 4) to allow access to the additional annulus created in the four-string configuration. This annulus access port is located at 90 degrees from the production casing/intermediate casing annulus access port 51 (FIG. 5). Both ports may be located at the same height as shown in these drawings. There is also one additional test port 53 (FIG. 4) through the wellhead housing to test an additional set of seals 135 on the tubing hanger.

This wellhead housing also demonstrates a different means of providing a reaction point for the hydraulic activation pistons and mechanical lock nuts. Instead of having a very thick section integral to the wellhead housing (as was shown in FIG. 2), this wellhead housing features a series of split flange sections 54 that fit in a dovetail groove 55 in a slightly thicker portion 136 of the wellhead housing. These flanges may then be bolted into place. At locations where annulus access port passes through the wellhead housing, a flat is machined to allow an annulus access valve to be bolted in place.

This system is used with a push-through wear bushing. This wear bushing protects the wellhead bore when drilling for the intermediate casing string. The wear bushing 39 is simply a thin sleeve with a thick top section. The bottom of the thin sleeve passes through the wellhead housing minimum inner diameter. A set of resilient seals 57 at the top of the wear bushing 39 prevents fluids from entering the protected area. The wear bushing may be supported in one of two ways. First, a pin through one of the annulus access ports can latch into a profile on the outer diameter of the wear bushing. This pin can then be removed when the wear bushing is ready to be moved out of the way. Alternately, the thick upper portion of the wear bushing may be gripped by the compression system 11. This system is released when the wear bushing is ready to be moved out of the way.

The thicker portion at the top of the wear bushing serves as a load shoulder 138 for the intermediate casing hanger. The wear bushing is released when the intermediate casing hanger is run. The load shoulder 140 on the intermediate casing hanger lands on the top of the mating load shoulder on the wear bushing and pushes the wear bushing downwards until the thick portion of the wear bushing is sandwiched between the lower load shoulder 142 on the wellhead housing and the load shoulder 140 on the intermediate casing hanger. These shoulder thicknesses are all sized to support full intermediate casing weight only. Any additional load on the intermediate casing hanger (due to loads from additional casing strings and seal test loads) is supported by the friction interface which is activated by the compression system 11.

The intermediate casing hanger 150 and intermediate casing hanger seal assembly 41 are largely identical to the production casing hanger 2 and production casing hanger annulus seal assembly 3 as discussed in FIG. 2. The intermediate casing hanger features a profile 58 on the inner diameter to land the production casing hanger 42. As a hanger does not land on top of the annulus seal as one did in the configuration of FIG. 2, the annulus seal is shorter, and does not have the requirement of ports for annulus access.

The production casing hanger 42 features a casing thread profile down for support of the production casing string 59. At the top end of the production casing hanger, there is a casing coupling box 152 to interface with the seal and support sub 43 and an external running thread profile to interface with the casing hanger's running tool (not shown). The exterior of the production casing hanger features slots to allow flow-by and cement returns to pass as the hanger is being run.

Held in a profile on the exterior of the production casing hanger is a split-ring landing mechanism 60 (FIG. 5). This outwardly biased split ring is held inwards by the casing hanger running tool while the hanger is being run. This allows the production casing hanger to pass completely through the bore of the intermediate casing hanger, and then be pulled back to the mating landing profile, thus applying tension to the production casing string. When the production casing hanger is properly located in the bore of the intermediate casing hanger, the outwardly-biased split ring is disengaged from the running tool. The split ring springs outwards and engages the mating profile in the bore of the intermediate casing hanger. This split ring supports intermediate casing string weight only. Any additional loads on the intermediate casing hanger (for instance, loads due to the tubing string or any seal test loads) are carried by the seal and support sub.

The seal and support sub 43 has a casing coupling pin down. This threaded and sealing connection is made up to the mating box 152 in the top of the production casing hanger 150. On the inner diameter above this coupling is a running profile 61 to mate with a running tool (not shown). Above this running profile, ports 62 (FIG. 4) pass from the seal and support sub inner diameter to the outer diameter to allow communication between the production casing/tubing annulus and the annulus access port 156.

At the outer diameter of the seal and support sub, these ports pass between a pair of metal-to-metal seals at seal assembly 160. The outer diameter of the seal and support sub features four sets of metal-to-metal seals 162 with resilient backup 63. The annulus access ports pass between the middle set of seals. The set of seals on either side of the annulus access port straddle external test ports in the wellhead housing wall, enabling testing of all sets of seals. Below all of these sealing profiles is a friction profile 64, consisting of a machined surface suitable for support of friction loads.

Both of these profiles are parallel to mating surfaces on the wellhead housing bore, and have no initial interference. When the upper compression cartridge 165 is activated, that section of the wellhead housing is compressed inwards to contact the seal and support sub. Contact pressure along this interface forces the pieces to be concentric, provides axial and rotational lockdown of the seal and support sub, and activates the metal-to-metal seals with resilient back-ups. The friction interface supports any test pressure loads on the seal and support sub and any weight from the tubing hanger.

The inner diameter of the support sub is a bowl that serves as a landing shoulder 170 for the tubing hanger 65. Above this landing shoulder is a bore with both a friction grip profile 66 and a sealing profile 67 for the tubing hanger.

The tubing hanger 65 is very similar to the tubing hanger 4 shown in FIG. 2. The tubing hanger 65 has a reduced outer diameter, allowing it to be run through a smaller blow out preventer (BOP) . This smaller tubing hanger is landed, locked down, and sealed inside the seal and support sub rather than inside the wellhead housing bore. In order to have capability to test the metal-to-metal seals on the tubing hanger outer diameter, a port 68 in the tubing hanger passes from the top face to intersect a test port that passes between the two sets of seals on the tubing hanger outer diameter.

To activate the seals and friction grip inside the seal and support sub requires a two-stage operation of the upper compression system 165. The first stage of activation compresses the wellhead housing inwards to grip, support, and seal the seal and support sub. During the second stage of activation, the compression system is activated further. This additional activation compresses through the seal and support sub, compressing the inner diameter of the seal and support sub inwards to grip the tubing hanger. This second-stage compression provides the force necessary to activate the metal-to-metal seals and the friction-grip support. The tubing hanger neck seal is identical to that shown FIG. 2.

From the foregoing description it will be readily understood that the platform wellhead design of the subject invention has numerous enhancements and features providing substantial advantages over the wellhead designs of the prior art. The wellhead as described herein achieves these advantages by moving load support and seal energization functions to the exterior to the wellhead housing. This results in maximization of useable bore space and excellent control of annular seal loading. These improvements result in the following advantages and features, among others:

- flexible design can be used for a variety of specific applications.
- Simple design promotes dependability and reduces size.
- Zero eccentricity between hangers and housing.
- Zero torque and minimal axial setting load required to energize metal-to-metal annular seals.
- External test capability for metal-to-metal annular seals.
- External lockdown and sealing activation Rigid lockdown eliminates annular seal fretting.
- Contact stress evenly distributed around seal perimeter.
- Controlled and monitored application of seal loading.
- Annular seals maintainable throughout field life.
- Minimal number of running tools required—since hangers are locked in place torsionally, a high-torque connection (in this case a standard casing coupling on the end of a standard casing string) can be used to run the hangers.
- The primary load shoulder can be quite a bit smaller than conventional multi-bowl load shoulders, as much of the load is supported through the various friction-grip interfaces. This smaller load shoulder means that the bore through the wellhead is increased, allowing the first casing string run through the wellhead to be larger in size. Alternately, a smaller load shoulder can allow the outer diameter of the wellhead to be decreased, resulting in a smaller overall size.
- The friction and gripping areas function over a length. Therefore, if the first casing hanger is landed high, subsequent casing hangers/tubing hangers can tolerate this stack-up error by landing and sealing at slightly different places along the bore length.
- As shown in FIG. 4, the tubing hanger can be nested to reduce the work-over stack dimension.
- Due to the fact that the friction grip area supports test loads on the tubing hanger, the tubing hanger load shoulder can be smaller than it would normally be. This means that more space is available in the tubing hanger to maximize the number of control line penetrations through the tubing hanger.

Minimum number of wellhead penetrations.

Contingency procedures can all be performed through the BOP's.

Fatigue resistant design for dynamic applications.

Flexible design allows incorporation of tensioned casing and tubing hangers (for instance as shown in FIG. 4).

Use of hydraulic pistons and lock nuts to activate and lock flanges allows simple flange design.

Push-through wear bushing does not need to be retrieved, saving an operation.

Internal tubing hanger lockdown without dedicated handling tool and potential control line damage Improved safety, with tubing back-side test achieved without use of temporary seal or temporary lockdown mechanism on tubing hanger.

While certain features and embodiments of the invention have bee described in detail herein, it should be understood that the invention includes all modifications and enhancements within the scope of the following claims.

What is claimed is:

1. A wellhead having an external sealing apparatus for clamping a tubing member having a first diameter within a tubing member of larger internal diameter, the arrangement comprising an outer tubing member having an inner circumferential wall with a sealing zone therein;

an inner tubing member adapted to be positioned substantially concentrically within the outer tubing member having an outer circumferential wall with a sealing zone therein; and a circumferential compression system mounted outwardly of the outer tubing member adjacent a sealing zone and operable to be activated for compressing the outer tubing member into full circumferential contact with the inner tubing member for engaging the sealing zones therein and activating a full circumferential seal between the outer tubing member and the inner tubing member, wherein the sealing zone is a metal sealing surface on each of said tubing members for defining a full circumferential metal-to-metal seal when the compressions system is activated.

2. The wellhead of claim 1, further comprising a resilient seal member in the sealing zone of one of the tubing members and extending therefrom toward the other tubing member, wherein the resilient seal member is adapted to be compressed between the two tubing members when the compression system is activated.

3. The wellhead of claim 2, including a second resilient seal member axially in the sealing zone and spaced axially from the first sealing member, creating a gap between the resilient seal members when the compression system is activated.

4. The wellhead of claim 3, including a test port for communicating the gap with the exterior of the assembly for testing the integrity of the seal when activated.

5. The wellhead apparatus of claim 1, wherein the compression system comprises a wedge surface and a flange adapted for engaging the wedge, on of said wedge and flange being each located on one of the outer tubular member and the compression system, whereby the tubular member is compressed radially inwardly upon relative axial movement between the wedge and the flange.

6. The wellhead of claim 5, wherein the compression system is a hydraulic ram adapted for causing axial movement between the wedge and the flange.

7. The wellhead of claim 6, further including a positive lock for locking the wedge and flange in position once the seal has been engaged.

8. The wellhead of claim 1, wherein the compression system comprises annular, axially tapering surface, an axially movable sleeve surrounding the outer wall of the wellhead and has a corresponding tapering surface facing the outer wall, and a driver for producing relative axial movement between the tapering surfaces to exert a radial compressive force to the outer wall of the wellhead.

9. The wellhead of claim 8, wherein the means for producing relative axial movement comprises a pressure chamber between the sleeve and the wellhead, and means for pressurizing the chamber with hydraulic pressure.

10. The wellhead of claim 9, wherein the means for producing relative axial movement comprises a flange on the sleeve, a flange on the wellhead, and means for applying a mechanical force between the flanges to move the sleeve axially along the wellhead.

11. The wellhead of claim 10, wherein a locknut is provided to lock the relative positions of the sleeve and the wellhead, once these components have been brought into an active, seal engaging position.

12. A method for sealing concentric tubular members in a wellhead, comprising the steps of:

a. providing metal sealing zones on the surfaces of a plurality of concentric tubing members in radial alignment with one another; and b. applying an external radial compressing force around the full circumference of the outermost tubular member adjacent the sealing zones toward the central axis of the concentric tubing members for engaging the sealing zones with one another;

c. wherein the compressing force causes a full circumferential metal to metal seal to form at said sealing zone between adjacent concentric tubing members.

13. The method of claim 12, including the step of locking the compressed assembly in sealing position.

14. The method of claim 12, further comprising the steps of placing a redundant resilient seal in the sealing zone, wherein the compressing force causes said redundant resilient seal to form a seal with an adjacent sealing zone surface.

15. The method of claim 12, including the step of placing a plurality of axially spaced redundant seals in the sealing zone.

16. The method of claim 15, including the step of porting the space between the axially spaced redundant seals to the exterior of the assembly.

17. A wellhead assembly comprising a well head, a first tubing member supported in the wellhead and at least one additional tubing member concentric with and of a smaller diameter than the first tubular member, the assembly comprising:

an external sealing apparatus for clamping a tubing member of a first diameter within a tubing member of larger internal diameter, the arrangement comprising an outer tubing member having an inner circumferential wall with a sealing zone therein;

an inner tubing member having an outer circumferential wall with a sealing zone therein, said inner tubing member adapted to be positioned substantially concentrically within the outer tubing member so that said sealing zones are radially aligned;

a resilient seal member in the sealing zone of one of the tubing members and extending therefrom toward the other tubing member;

a clamp assembly adjacent the sealing zones for securing a rigid, generally cylindrical outer tubing member to a rigid, generally cylindrical inner tubing member, the clamp assembly comprising:

an annular compression member radially surrounding the outer tubing member, the annular compression member having a pair of opposed, outwardly-facing ramp surfaces;

a pair of collars radially surrounding the compression member, each of the collars having an inwardly-facing ramp surface for contacting and adjoining one ramp surface of the compression member;

means for axially moving the pair of collars with respect to one another to cause the annular compression member to be deformed radially inwardly to cause the outer tubing member to grip the inner tubing member in a primary clamping grip; and a locking system to prevent substantial movement of the inner tubing member with respect to the outer tubing member.

18. The assembly of claim 17, further including a circumferential compression system mounted outwardly of the outer tubing member and operable to be activated for compressing the outer tubing member into contact with the inner tubing member for engaging the sealing zones therein and activating a seal between the outer tubing member and the inner tubing member.

19. The assembly of claim 17, wherein the clamp assembly is also operable to be activated for compressing the outer tubing member into contact with the inner tubing member for engaging the sealing zones therein and activating a seal between the outer tubing member and the inner tubing member.

20. The assembly of claim 17 wherein the locking system comprises:

an outwardly and downwardly facing first tapered shoulder associated with the inner member; and a complementary inwardly and upwardly facing second tapered shoulder associated with the outer member, the first and second shoulders engaging one another upon failure of the primary clamping grip.

21. The clamp assembly of claim 20 wherein the first tapered shoulder is formed upon an annular member that is affixed by at least one threaded connection to the inner tubing.

22. The clamp assembly of claim 21 wherein the second tapered shoulder is formed within an inner surface of the outer member.

23. The clamp assembly of claim 17, wherein the locking system comprises a slip member disposed between the inner tubing member and outer tubing, said slip member shaped and sized to cause a mechanical gripping between the inner tubing member and outer tubing in the event the primary clamping grip fails.

24. The clamp assembly of claim 23, wherein the slip member is an annular member.

25. The clamp assembly of claim 23, wherein the slip member is a segment of an annular member.

26. The clamp assembly of claim 23, wherein the slip member presents a notched inner surface for gripping the inner tubing member.

27. The clamp assembly of claim 23, wherein the slip member presents a downwardly-tapered outer surface for engagement of a complementary surface on the outer tubing.

28. A wellhead assembly comprising:

an inner, generally cylindrical tubing defined by an outer circumference;

an outer, generally cylindrical tubing that radially surrounds the inner tubing member, the outer tubing defined by inner and outer circumferences;

an external sealing apparatus around the full outer circumference of the outer tubing for full circumferential metal-to-metal sealing of the annulus between the inner tubing and the outer tubing, comprising a sealing zone on the internal wall of the outer tubing;

a complementary sealing zone on the outer wall of the inner tubing;

a resilient seal member in the sealing zone of one of the tubing members and extending therefrom toward the other tubing member;

a plurality of clamping arrangements adjacent the sealing zones secured around the full circumference of to the outer tubing, each of said clamping arrangement being selectively moveable between a first position wherein the clamping arrangement does not seal the outer tubing to the inner tubing member and a second position wherein the clamping arrangement radially compresses the full circumference of the outer tubing radially inwardly, each of the clamping arrangements, one of said clamping arrangements radially aligned with the complementary sealing zones, the clamping arrangements comprising:

an annular compression member radially surrounding the outer tubing, the annular compression member having a pair of opposed, outwardly-facing ramp surfaces;

pair of collars radially surrounding the compression member each of the collars having an inwardly-facing ramp surface for contacting an adjoining one ramp surface of the compression member; and means for axially moving the pair of collars with respect to one another to cause the annular compression member to be moved radially inwardly to cause the outer tubing to be compressed radially inwardly.

29. The assembly of claim 28, wherein the clamping arrangements are located at intervals along the outer tubing.

30. The assembly of claim 28, wherein the sealing zones are each a metal sealing surface on each of said tubing members for defining a metal-to-metal seal when the compressions system is activated.

31. The assembly of claim 28, further including a resilient seal member in the sealing zone of one of the tubing members and extending outwardly therefrom toward the other tubing member, wherein the resilient seal member is adapted to be compressed between the two tubing members when the compression system is activated.

32. The assembly of claim 31, including a second resilient seal member axially in the sealing zone and spaced axially from the first sealing member, creating a gap between the resilient seal members when the compression system is activated.

33. The assembly of claim 32, including a test port for communicating the gap with the exterior of the assembly for testing the integrity of the seal when activated.

34. The assembly of claim 28, wherein the compression system comprises a wedge surface and a flange adapted for engaging the wedge, on of said wedge and flange being each located on one of the outer tubular member and the compression system, whereby the tubular member is compressed radially inwardly upon relative axial movement between the wedge and the flange.

35. The assembly of claim 34, wherein the compression system is a hydraulic ram adapted for causing axial movement between the wedge and the flange.

36. The assembly of claim 35, further including a positive lock for locking the wedge and flange in position once the seal has been engaged.

37. The assembly of claim 28, wherein the compression system comprises annular, axially tapering surface, an axially movable sleeve surrounding the outer wall of the wellhead and has a corresponding tapering surface facing the outer wall, and a driver for producing relative axial movement between the tapering surfaces to exert a radial compressive force to the outer wall of the wellhead.

38. The assembly of claim 37, wherein the means for producing relative axial movement comprises a pressure chamber between the sleeve and the wellhead, and means for pressurizing the chamber with hydraulic pressure.

39. The assembly of claim 38, wherein the means for producing relative axial movement comprises a flange on the sleeve, a flange on the wellhead, and means for applying a mechanical force between the flanges to move the sleeve axially along the wellhead.

40. The assembly of claim 39, wherein a locknut is provided to lock the relative positions of the sleeve and the wellhead, once these components have been brought into an active, seal engaging position.

* * * * *